US006264771B1

(12) United States Patent
Bornschlegl et al.

(10) Patent No.: US 6,264,771 B1
(45) Date of Patent: Jul. 24, 2001

(54) PROCESS FOR FORMING A PLATE-LIKE COMPONENT

(75) Inventors: Heinz Bornschlegl, Diessen; Winfried Köhler, Hagnau, both of (DE)

(73) Assignee: Daimler-Benz Aerospace AG, Munich (DE)

( * ) Notice: Subject to any disclaimer, the term of this patent is extended or adjusted under 35 U.S.C. 154(b) by 685 days.

(21) Appl. No.: 08/594,709

(22) Filed: Jan. 31, 1996

(30) Foreign Application Priority Data

Feb. 3, 1995 (DE) ..... 195 03 620

(51) Int. Cl.[7] ..... C22F 1/04; C22F 1/057

(52) U.S. Cl. ..... 148/710; 148/697; 148/698; 148/699; 72/53; 29/90.7

(58) Field of Search ..... 148/708, 710, 148/622, 624, 627, 640, 698, 699, 697; 72/53; 29/90.7

(56) References Cited

U.S. PATENT DOCUMENTS 5,144,825 * 9/1992 Burg et al. ..... 29/889.7

FOREIGN PATENT DOCUMENTS 38 42 064 6/1990 (DE) .
43 05091 3/1994 (DE) .
513091 * 5/1976 (SU) .

* cited by examiner

*Primary Examiner*—Sikyin Ip
(74) *Attorney, Agent, or Firm*—Crowell & Moring, L.L.P.

(57) ABSTRACT

This invention provides a method of forming a component made of an artificially and plastically formable material which can be hardened by artificial aging. The component is first shot-peen-formed in the unhardened condition and is subsequently, artificially aged. During artificial aping it is subjected to an exterior pressure load causing a creep of the impact-body-forming material to conform to a mold having the desired shape.

14 Claims, 2 Drawing Sheets

PROCESS FOR FORMING A PLATE-LIKE COMPONENT

BACKGROUND AND SUMMARY OF THE INVENTION

This invention relates to a process for forming a plate-like component, such as a fuel tank bottom segment for a spacecraft.

To produce double-curved components made of a hardened metallic material, it is known to form a plane, pie-shaped blank simultaneous with the thermal hardening, by clamping the blank to a mold shell having a curved contour corresponding to the desired component contour, and subjecting it to externally applied pressure during the thermal hardening cycle. The intensity of the pressure is selected so that, taking into account its thermal hardening temperature, the creep resistance of the material is exceeded, and that the blank conforms to the contour of the mold shell in the course of the artificial aging. However, with this so-called age creep forming, substantial spring-back effects occur after the forming which, particularly in the case of large-surface blanks, cause considerable deviation of the resulting component geometry from the contour of the mold shell. In the case of thin components, there is also the danger of local wrinkling. To prevent such wrinkling, the component must be thickened beyond the structural required thickness, which is a serious disadvantage with respect to material and weight efficiency, particularly of components for aviation and space travel. In addition, the characteristics of the material, such as the mechanical strength and the yield point of the component thus produced are below the maximum values which are achievable for the material.

An alternative production process for components of this type is known as shot peen forming. In this process, a hardened component blank is formed into a double curved contour with precision and relatively low production expenditures and without the above-mentioned production-related difficulties concerning age creep forming. However, this process suffers from the disadvantage that the material characteristics of the finished component, specifically its residual ductility, do not reach optimum values which can be realized for the selected material as such.

An object of the invention to provide a manufacturing process of the generic type described above, which is simple and can achieve improved mechanical characteristics of the material of the formed and hardened component.

This object is achieved by the process according to the invention, which is based on the principle that the residual ductility of a shot-peen-formed thermally hardened component is significantly increased, and variations in its material strength are considerably reduced if, in its still unhardened condition, the component is shot-peen-formed and then artificially aged under external pressure which causes creep effects in the material. As a result of the combination of peen-forming and thermal hardening of the workpiece blank with a simultaneous application of external pressure, a high quality component is obtained with material characteristics that are clearly improved in comparison to each of the initially mentioned production processes. Even large surface, double-curved components made of metallic, thermally hardening materials (such as nonferrous metal alloys, as they are used in aviation and space travel) can be produced, while the material is utilized in a weight-saving, precisely contoured and simple manner, at reasonable cost.

In a particularly preferred embodiment, during the artificial aging the thermal hardening temperature is maintained up to approximately 12% and the thermal hardening time is maintained to approximately 20% below the values for the unformed material, as specified in commonly available material specification pamphlets. Because of the above-mentioned shot-peen-forming, the maximum hardening effect of the artificial aging shifts in the direction of lower thermal hardening temperatures and times, and as a result, the mechanical component characteristics and particularly the material strength are further improved.

In another preferred embodiment, the shot-peen-formed component is placed under pressure during the artificial aging process in a full-surface mold shell, with a mold face corresponding to the final component contour. In this manner, during the creep process generated by the pressure and the temperature during the thermal hardening, the formed component is maintained in a stable form, and inaccuracies of the contour, which may remain in the component after the peen-forming and internal tensions resulting in back-springing, are automatically compensated in a simple manner.

In order to ensure a uniform surface pressure in the pressing tool with low expenditures for manufacturing means, even for components which have a smooth curved surface on only one side, but are non-uniformly profiled on the opposite component side (being thickened in an approximately step-shaped manner), the mold space of the pressing tool on the component side facing away from the mold face is expediently sealed off by a flexible boundary wall which is pressured by an external pressure medium during the artificial aging. The action by the pressure medium and the artificial aging preferably take place in an autoclave, and the mold space between the flexible boundary wall and the mold face is evacuated to increase component compression.

Other objects, advantages and novel features of the present invention will become apparent from the following detailed description of the invention when considered in conjunction with the accompanying drawings.

DETAILED DESCRIPTION OF THE DRAWINGS

Figure 1:
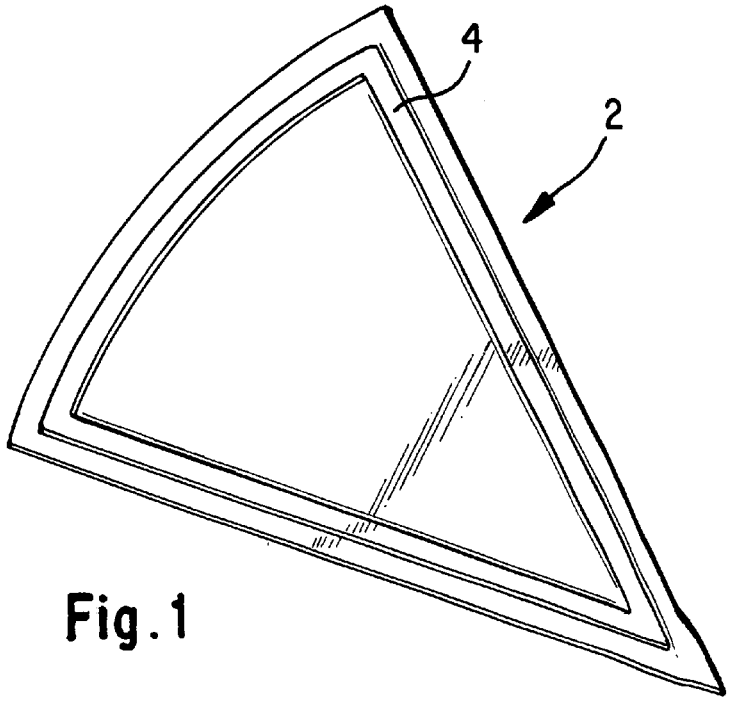
FIG. 1 is a schematic view of a plane, pie-shaped component blank in an unformed condition.

The figures of the drawings illustrate the production of a spherically curved bottom segment of a fuel tank for a spacecraft. As shown in FIG. 1, a pie-shaped blank 2 is first produced from a plane metal plate, for example, from a weldable aluminum copper alloy with a 6% constituent of copper. Depending on the required wall thickness of the tank bottom the blank is machined in a conventional free-cutting manner to provide step-thickenings 4 having an increased wall thickness along the periphery of the blank.

Figure 2:
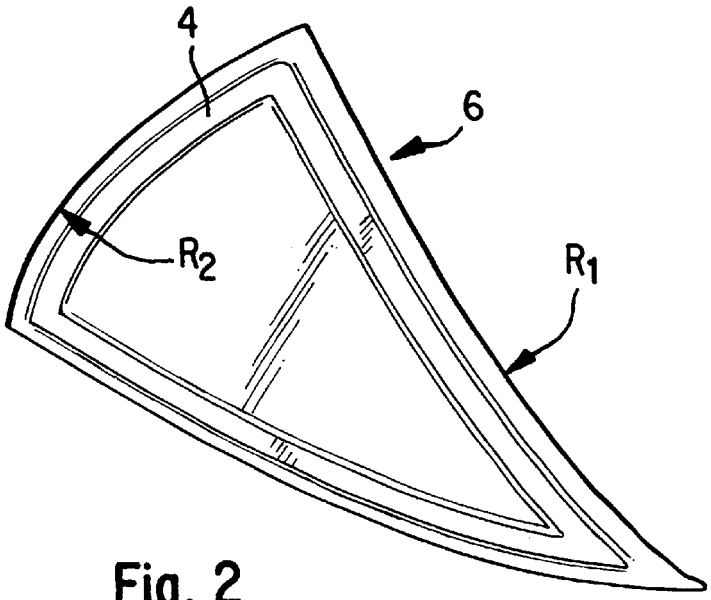
FIG. 2 is a schematic view of the component after shot peen forming into a double-curved contour.

Subsequently, the component blank 2 is cold-formed by conventional shot peen forming so that its contour corresponds at least approximately to the spherically curved final contour of the tank bottom segment 6 to be produced (FIG. 2). A suitable cold forming process of this type is disclosed, for example, in German Patent Document DE 38 42 064 C2.

Figure 3:
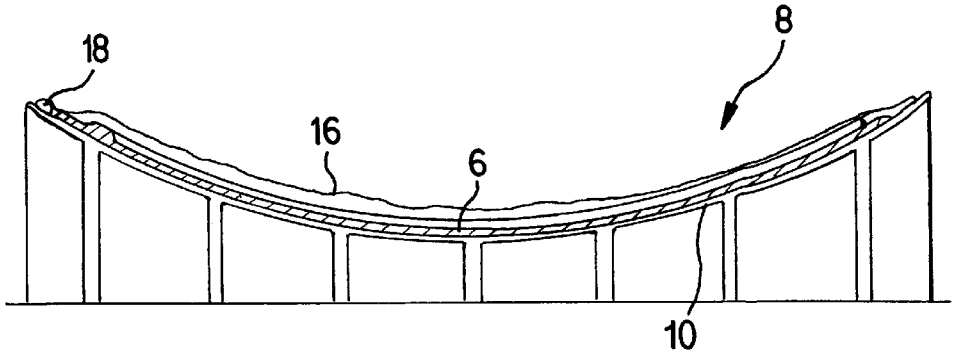
FIG. 3 is a schematic view of the component during artificial aging and action by the pressure in a pressing tool.
Figure 4:
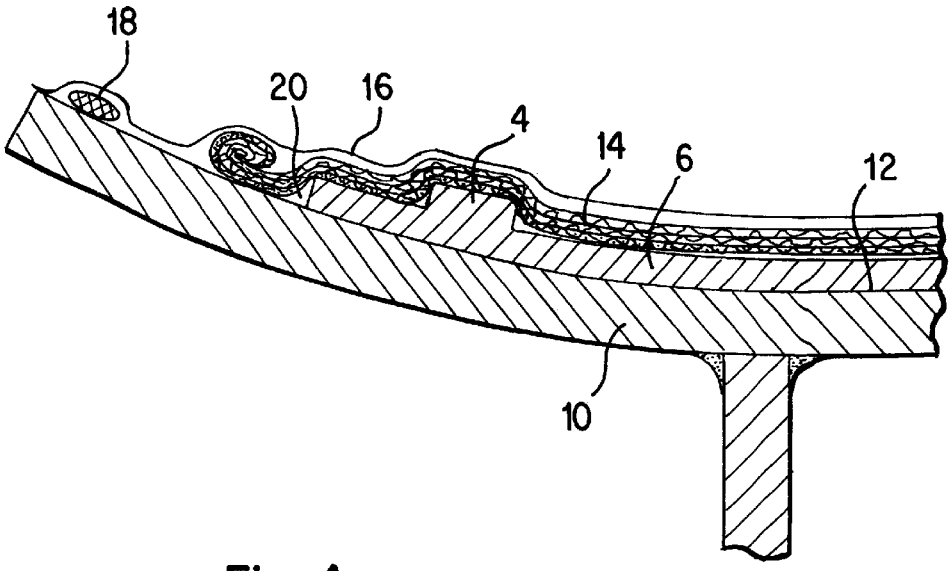
FIG. 4 is an enlarged view of a portion of the pressing tool according to FIG. 3.

The formed component 6 is then placed in a pressing tool 8 (FIG. 3) which contains a rigid mold shell 10 made, for example, of a carbon fiber composite with a mold face 12 that is spherically curved corresponding to the desired final contour of the component. On its interior side, with the thickenings 4, the component 6 is covered by a flexible vacuum foil 16 and an intermediate layer of an air-permeable absorption fabric 14. The vacuum foil 16 is sealed at its edge with the mold shell 10 by means of a sealing mass.

The pressing tool 8 with the component 4 enclosed in the mold space 20 between the mold face 12 and the vacuum foil 16 is then placed into an autoclave (not shown), where it is artificially aged, with the thermal hardening temperature maintained at approximately 12%, and the thermal hardening time maintained at approximately 20%, below the values for unformed material. Simultaneously with the thermal hardening, the mold space is evacuated and the autoclave pressure is held at such a high level that the component material is caused to creep.

After completion of the thermal hardening cycle, the component 6 is finished and may be welded with other components produced in the same manner to form a semi-spherical tank bottom of a fuel tank for a spacecraft.

The following is an example of a specific embodiment of the invention. A ring-sector-shaped, plane component blank 2 made of the above-mentioned material with a radial length of 2,500 mm and a width of 2,100 mm is produced, and is shaped in a free cutting manner to a wall thickness of 1.3 mm, with localized thickenings 4 of up to 4.5 mm. By means of shot peen forming, the component is shaped to curve about two axes (radius of curvature $R_1$ approximately 3,000 mm and radius of curvature $R_2$ approximately 2,700 mm). The artificial aging in the pressing tool 8 takes place at an autoclave pressure of 5 bar with a heating rate of 30° C./h and a holding time of 14 hours at 160° C.

In the component thus produced, all remaining inaccuracies of the contour were eliminated. By means of samples, it was determined that, in comparison to a component of the same type which was ball shot formed but thermally hardened without a creep process, the characteristics of the material could be improved considerably and the required desired values were exceeded. The main advantages were a higher residual expansion and mechanical strength as well as a reduction of the variation of the material characteristics within the component surfaces, with the almost complete reduction of inherent tensions.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Process for forming a plate-shaped component made of an elastically and plastically formable material which can be hardened by artificial aging, said process comprising the steps of:

impact-body-forming the component into a double-curved shape;

thereafter artificially aging the component; and during said artificial aging, subjecting the component to externally applied pressure of a value to exceed the creep resistance of the material.

2. Process according to claim 1, wherein the thermal hardening temperature and time of a artificial aging are maintained below the values used for the unformed material.

3. Process according to claim 1, wherein said step of subjecting the component to externally applied pressure is performed in a pressing tool with a mold face corresponding to the final component contour, and the impact-body-formed component is acted upon by pressure over the full surface.

4. Process according to claim 3, wherein a mold space of the pressing tool on a component side facing away from the mold face is sealed off by a flexible boundary wall which is acted upon from the outside by a pressure medium during the artificial aging.

5. Process according to claim 4, wherein said mold space is evacuated during the exterior action of the pressure medium and the artificial aging of the component.

6. Process according to claim 1, wherein said formable material is metallic.

7. Process according to claim 1, wherein said step of impact-body-forming the component comprises shot-peen-forming.

8. Process for forming a plate-shaped component made of an elastically and plastically formable material which can be hardened by artificial aging, essentially consisting of the steps of:

impact-body-forming the component into a predetermined shape;

thereafter artificially aging the component while subjecting the component to externally applied pressure sized to exceed creep resistance of the material.

9. Process according to claim 8, wherein a thermal hardening temperature and time of the artificial aging are maintained below the values used for the unformed material.

10. Process according to claim 8, wherein said step of subjecting the component to externally applied pressure is performed in a pressing tool with a mold face corresponding to the final component contour, and the impact-body-formed component is acted upon by pressure over the full surface.

11. Process according to claim 10, wherein a mold space of the pressing tool on a component side facing away from the mold face is sealed off by a flexible boundary wall which is acted upon from the outside by a pressure medium during the artificial aging.

12. Process according to claim 11, wherein said mold space is evacuated during the exterior action of the pressure medium and the artificial aging of the component.

13. Process according to claim 8, wherein said formable material is metallic.

14. Process according to claim 8, wherein said step of impact-body-forming the component comprises shot-peen-forming.

* * * * *